US007468008B2

(12) United States Patent
Shin

(10) Patent No.: US 7,468,008 B2
(45) Date of Patent: Dec. 23, 2008

(54) GOLF TEE SETTER

(76) Inventor: Phillip B. Shin, 2768 Rockpine La., La Crescenta, CA (US) 91214

( * ) Notice: Subject to any disclaimer, the term of this patent is extended or adjusted under 35 U.S.C. 154(b) by 0 days.

(21) Appl. No.: 11/633,047

(22) Filed: Dec. 4, 2006

(65) Prior Publication Data

US 2008/0132360 A1 Jun. 5, 2008

(51) Int. Cl.
*A63B 57/00* (2006.01)

(52) U.S. Cl. ..... 473/400; 473/386

(58) Field of Classification Search ..... 473/387–403, 473/386; D21/717–719; 411/57.1
See application file for complete search history.

(56) References Cited

U.S. PATENT DOCUMENTS

| | | | | |
|---|---|---|---|---|
| 1,104,544 | A * | 7/1914 | Raeger | 411/57.1 |
| 1,616,059 | A * | 2/1927 | Mulvehill | 473/398 |
| 1,670,123 | A * | 5/1928 | Ranseen | 473/396 |
| 1,679,579 | A * | 8/1928 | Lundy | 473/396 |
| 2,011,203 | A * | 8/1935 | Seiki | 473/396 |
| 3,606,344 | A | 9/1971 | Ball | |
| 4,516,780 | A * | 5/1985 | Tabet | 473/398 |
| 4,917,552 | A * | 4/1990 | Crawford | 411/32 |
| 5,052,689 | A | 10/1991 | Lettrich | |
| 5,186,455 | A | 2/1993 | Rosetta | |
| 5,221,167 | A * | 6/1993 | Girkin et al. | 411/45 |
| 5,242,161 | A | 9/1993 | Wilkirson | |
| D340,270 | S | 10/1993 | Jones | |
| 5,890,976 | A | 4/1999 | Anderson | |
| D479,296 | S | 9/2003 | McCall | |
| D492,374 | S | 6/2004 | Barouh | |
| 6,769,999 | B1 | 8/2004 | Chase | |
| D511,193 | S | 11/2005 | Trawoeger | |
| D517,138 | S | 3/2006 | Barouh | |
| 7,086,972 | B2 | 8/2006 | Bainbridge | |
| 7,090,594 | B2 | 8/2006 | Kawashima et al. | |
| D538,874 | S * | 3/2007 | Ceruti | D21/796 |
| 2005/0130769 | A1 * | 6/2005 | Olsen | 473/387 |

FOREIGN PATENT DOCUMENTS

| | | | |
|---|---|---|---|
| JP | 2005305058 A | * | 11/2005 |
| WO | WO 9406520 A1 | * | 3/1994 |

* cited by examiner

*Primary Examiner*—Steven Wong
(74) *Attorney, Agent, or Firm*—Rapkin Gitlin & Beaumont; Larry F. Gitlin

(57) ABSTRACT

In combination with a golf tee having a top portion for supporting a golf ball, a neck portion, a shaft section and a pointed end, a device adapted to assist in penetrating the golf tee into the ground to ensure a pre-determined height for the golf ball comprising a generally tubular sleeve having a hollowed cylindrical cavity through its longitudinal center to receive the golf tee shaft therethrough, a generally annular end portion adapted to be positioned back from the pointed end, the end portion also having an inner diameter and two or more circumferentially spaced segments with leading edges adapted to outwardly flare when engaged by a shaft section having a larger outer diameter than the inner diameter of the end portion. Also provided is an enlarged tubular top section diverging upwardly from the generally tubular sleeve to engage and abut the golf ball support. An alternative embodiment of the device comprises an annular flange formed along the leading edges of the circumferentially spaced segments adapted to radially enlarge the end portion of the device to provide a wider area to bear against the ground surface to further stabilize the golf tee.

5 Claims, 4 Drawing Sheets

GOLF TEE SETTER

BACKGROUND OF THE INVENTION

1. Field of the Invention

The present invention relates generally to the field of the game of golf, and more particularly to a device used to assist in penetrating a golf tee into the ground to ensure a pre-determined height and stability for the golf ball while preparing for and making the shot.

2. Description of the Prior Art

A preliminary patentability and novelty search in connection with the invention has revealed the existence of the following U.S. Pat. Nos. 5,242,161; 3,606,344; 5,890,976; 5,186,455; and D479,296.

Referring to the patents listed above in the order of their issuance,

1. U.S. Pat. No. 5,242,161. This reference is directed to an adapter in three embodiments for a conventional golf tee that insures that the tee is inserted in the ground so as to maintain the ball at a desired height. The cylindrical device has a plurality of detachable segments that allow the golfer to remove sections in order to adjust the height of the device and therefore the resultant height of the golf tee. The device has the plurality of detachable segments that either could be discarded or manufactured so that they can be reassembled by engaging the top of one another. The first embodiment is a cylindrical device with the center aperture smaller than the top of the tee so that they will engage and allow the tee to protrude slightly from the device. The second embodiment is similar to the first, except a flange is provided at the bottom of the device to engage the ground and more easily achieve perpendicularity of the tee to the ground. The third embodiment has a notch between the flange and the cylindrical portion to improve grip and is shown with the center aperture having clearance to the golf tee shown so that it could be removed after the tee is set.

2. U.S. Pat. No. 3,606,344. This reference is directed to a set of protective shrouds for golf tees. The shrouds are formed of resilient material in a hollow tubular shape with the top end flared to engage and firmly grip a tee head and the other end being flared sufficiently large to provide a wide area stabilizing support for the tee. The shrouds would be provided in a set of graduated lengths for use to provide a desired height of the ball.

3. U.S. Pat. No. 5,890,976. This reference is directed to an encasement device for a golf tee which permits golfers to consistently place the golf tee in the ground at a desired depth because of graduated markings provided along its length. The cover is cylindrically adhered to the shaft portion of a golf tee and can be of any shape or form, rectangular, tubular, or the like. The cover could be constructed from paper, rubber, metal, mylar, wood, composite materials, or similar substances.

4. U.S. Pat. No. 5,186,455. This reference is directed to a protective collar for golf tees that also marks the position that the golf tee should be placed into the ground. The collar has a tubular outer cover member made of resilient but hard, high impact resistant material. The outer cover member is filled with a soft resilient inner cushioning member having an axially extending center hole so as to receive the golf tee. The center hole in the cushioning member is sized so that the golf tee is a snug fit so as to retain the collar securely on the golf tee.

5. U.S. Pat. No. D479,296. This reference is directed to the ornamental design for a stackable golf tee shroud, as shown in FIGS. 1-8. The shrouds are apparently a sleeve structure with an aperture in the middle designed to receive the shaft of a golf tee. The shroud is used with a golf tee to limit the distance the tee is inserted into the ground so as to maintain the ball at a desired height. Shrouds are shown with different lengths and the inside diameter of the bottom of the shroud is equal to the outside diameter of the top portion of the shroud, apparently so that they will fit together when stacked.

It requires only a brief examination of the aforesaid patents to understand that the respective teachings disclosed are vastly different from the structure of the present invention.

Thus, among the various items of equipment that a golfer uses to play the game are the clubs, the golf ball and the tee, which is placed in the ground and used to elevate the ball and attempt to stabilize it at a pre-determined height. The tee shot occurs with the first drive of each hole. To ensure that the shot achieves proper distance and direction, the tee should be used to elevate and hold the ball at a consistent height throughout the game. But this can be difficult, if the pre-determined height that the golfer seeks relies solely on the golfer's ability to consistently penetrate the tee into the ground the same distance each and every time. Without the use of a guide or some other type of mechanical device to assist in this objective, the attempt at any such height consistency is nearly impossible. Ultimately, this will negatively affect the golfer's game and naturally, the score.

Nothing in the prior art provides a device that is as capable and versatile as the device of the present invention, specifically with its ability to both ensure consistently the pre-determined height of the ball when the tee penetrates the ground in preparing the ball for the shot and to accommodate, with the same device, golf tees of various lengths and shaft thicknesses.

SUMMARY OF THE INVENTION

The present invention provides, in combination with a golf tee having a dish-shaped top portion for supporting a golf ball, a neck portion, a shaft section and a pointed end, a device adapted to assist in penetrating the golf tee into the ground to ensure a pre-determined height for the golf ball. This device comprises a generally tubular sleeve having a hollowed cylindrical cavity through its longitudinal center to receive the golf tee shaft therethrough, a generally annular end portion adapted to be positioned back from the pointed end, the end portion also having an inner diameter and two or more circumferentially spaced segments with leading edges adapted to outwardly flare when engaged by a shaft section having a larger outer diameter than the inner diameter of the end portion. Also included is an enlarged tubular top section diverging upwardly from the generally tubular sleeve to engage and abut the neck portion. An alternative embodiment of the device comprises an annular flange formed along the leading edges of the circumferentially spaced segments. This flange is adapted to radially enlarge the end portion of the device to provide a wider area to bear against the surface of the ground to further stabilize the golf tee.

Accordingly, it is the object of the present invention to provide, in combination with a golf tee, a device adapted to assist in penetrating the golf tee into the ground to ensure a pre-determined height and stability for the golf ball.

Another object of the present invention is to provide such a device with an annular end portion adapted to be positioned back from the pointed end of the golf tee to allow the pointed end to penetrate the ground a pre-determined distance.

Another object of the present invention is to provide such a device with an annular end that includes two or more circumferentially spaced segments that are adapted to outwardly flare when engaged by a large shaft section of a golf tee to provide a wider area to bear against the ground surface to improve stability to the tee and the golf ball.

Another object of the present invention is to provide such a device with an annular flange formed along the leading edges of the spaced segments to provide even a wider area to bear against the ground surface to further improve the stability of the tee and golf ball.

Still another object of the present invention is to provide such a device that can accommodate golf tees of many different lengths and shaft thicknesses.

Still another object of the present invention is to provide a device that is easy to use.

Still another object of the present invention is to provide a device that is easy and cost effective to manufacture.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

Figure 1:
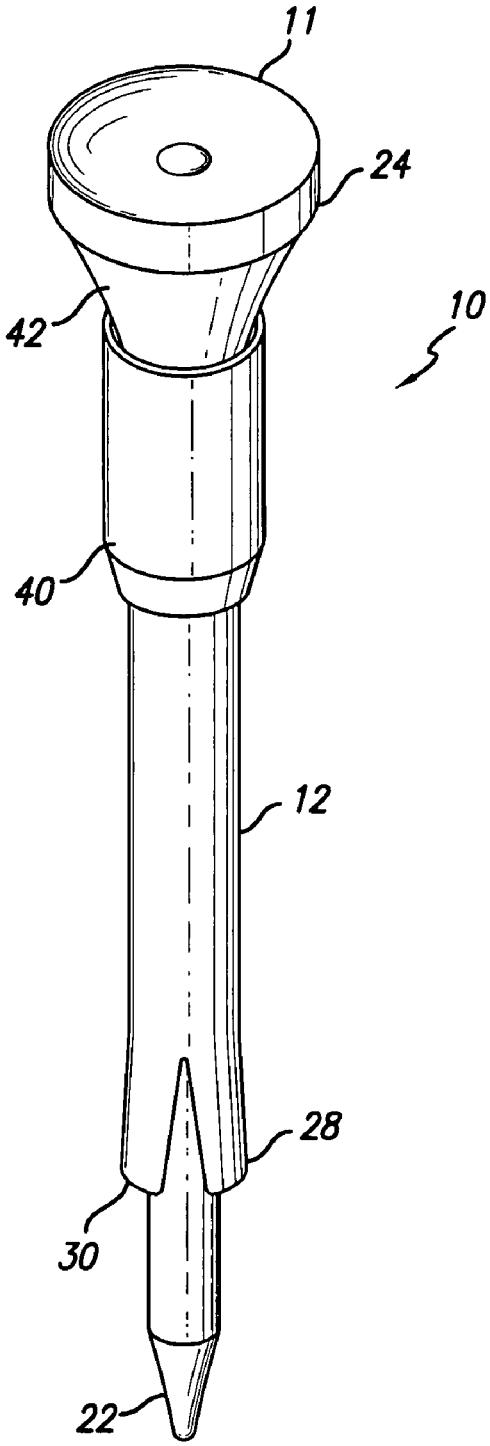
FIG. 1 is a perspective view of the preferred embodiment of the device of the present invention shown in combination with a golf tee.
Figure 2:
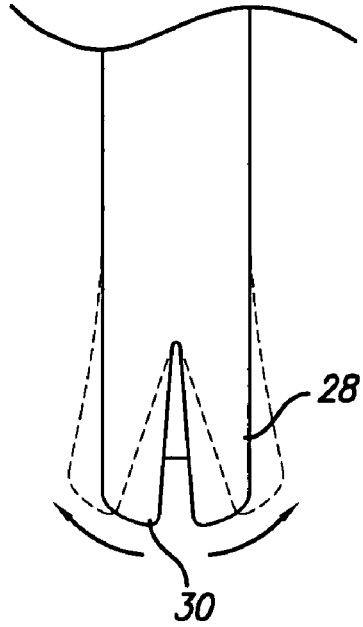
FIG. 2 is a sectional perspective view of one end of the device of the present invention depicting the outwardly flare of the spaced segments.
Figure 3:
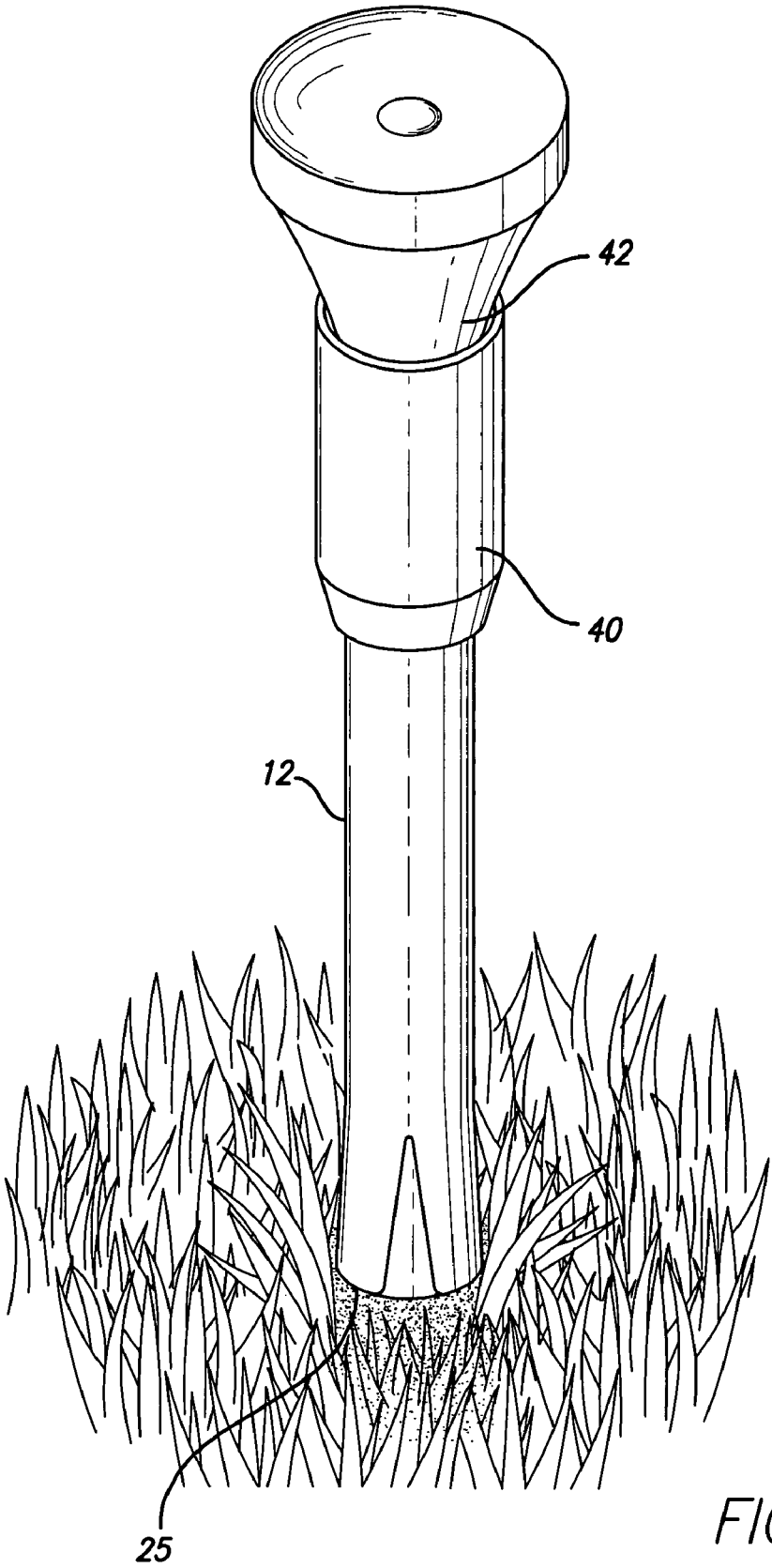
FIG. 3 is a perspective view of the device of the present invention shown assisting a golf tee in penetrating the ground and further depicting the device abutting the ground.
Figure 4:
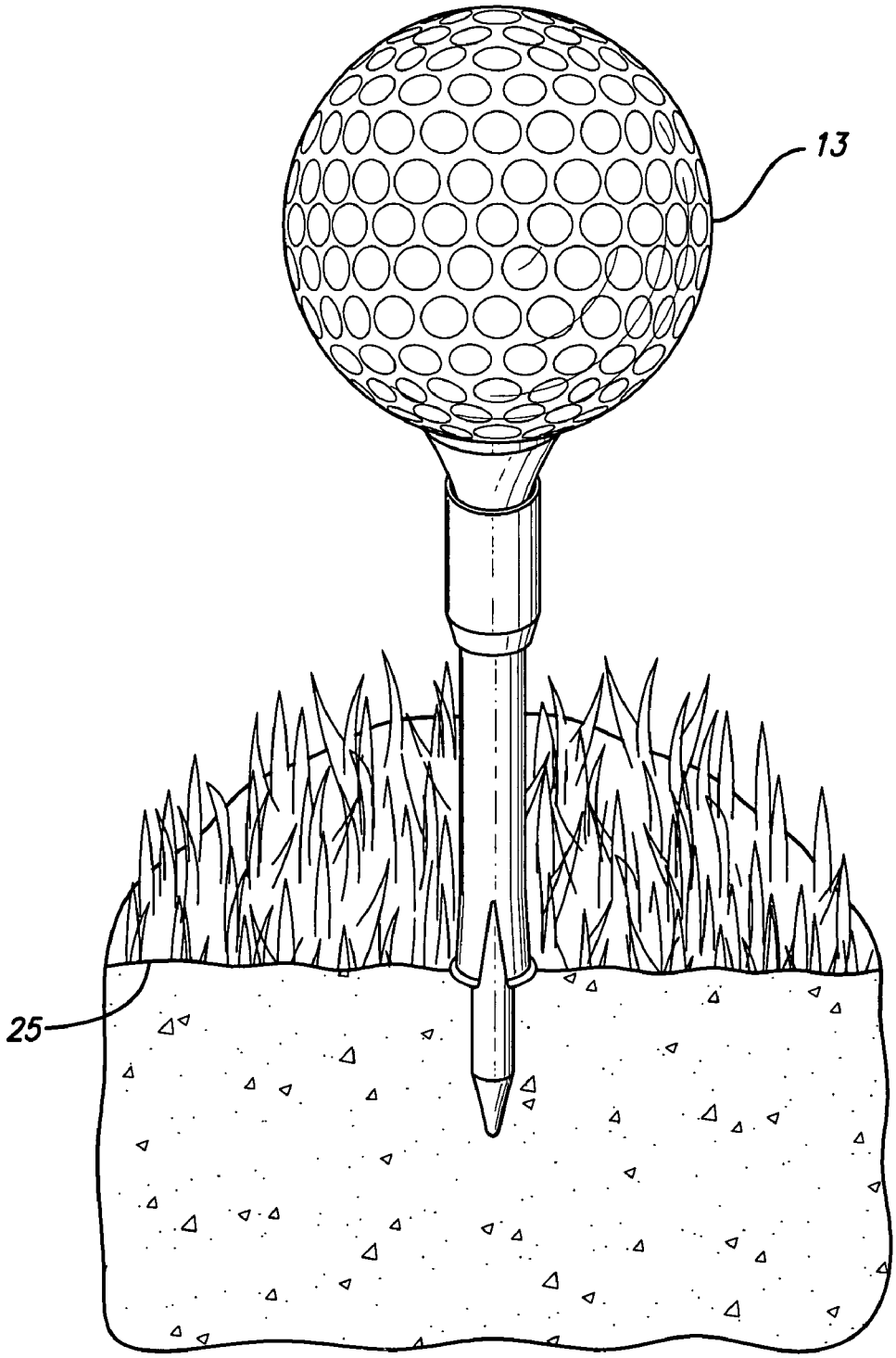
FIG. 4 is a perspective view of the device of the present invention, as shown in FIG. 3, with the addition of the flange formed along the leading edges of the spaced segments, with the golf tee holding a golf ball at a pre-determined height.
Figure 5:
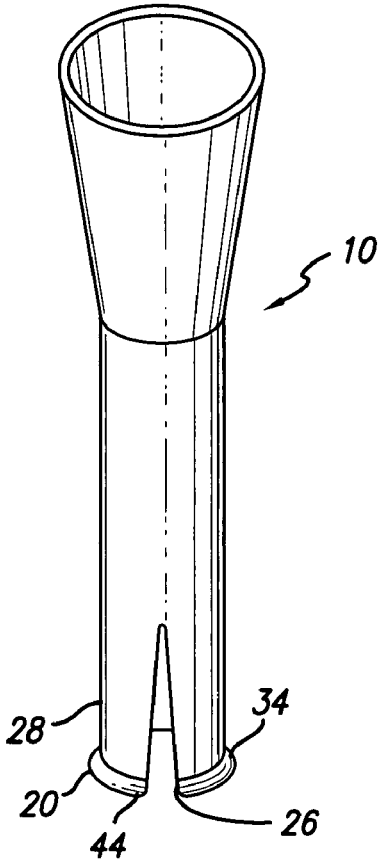
FIG. 5 is a perspective view of an alternate embodiment of the device of the present invention shown with a conical upper end and the annular flange formed along the edges of the lower end.
Figure 7:
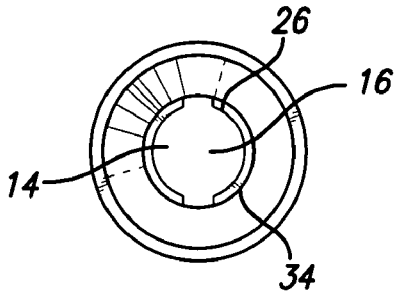
FIG. 7 is a top perspective view of the device of the present invention.

FIG. 1 illustrates the preferred embodiment of device 10 in accordance with the present invention. Device 10, which is used in combination with golf tee 24 having top portion 11 for supporting golf ball 13 and neck portion 42, shaft section 32 and pointed end 22, is adapted to assist in penetrating golf tee 24 into ground 25 to ensure a pre-determined height for golf ball 13. Device 10 comprises generally tubular sleeve 12 having hollow cylindrical cavity 14 through its longitudinal center 16 to receive golf tee shaft section 32 therethrough, generally annular end portion 20 adapted to be positioned back from pointed end 22 of golf tee 24. End portion 20 includes inner diameter 26 and two or more circumferential space segments 28 with leading edges 30 adapted to outwardly flare when engaged by shaft section 32 having a larger outer diameter 34 than inner diameter 26 of end portion 20. Enlarged tubular top section 40 diverges upwardly from tubular sleeve 12 to engage and abut neck portion 42.

Figure 6:
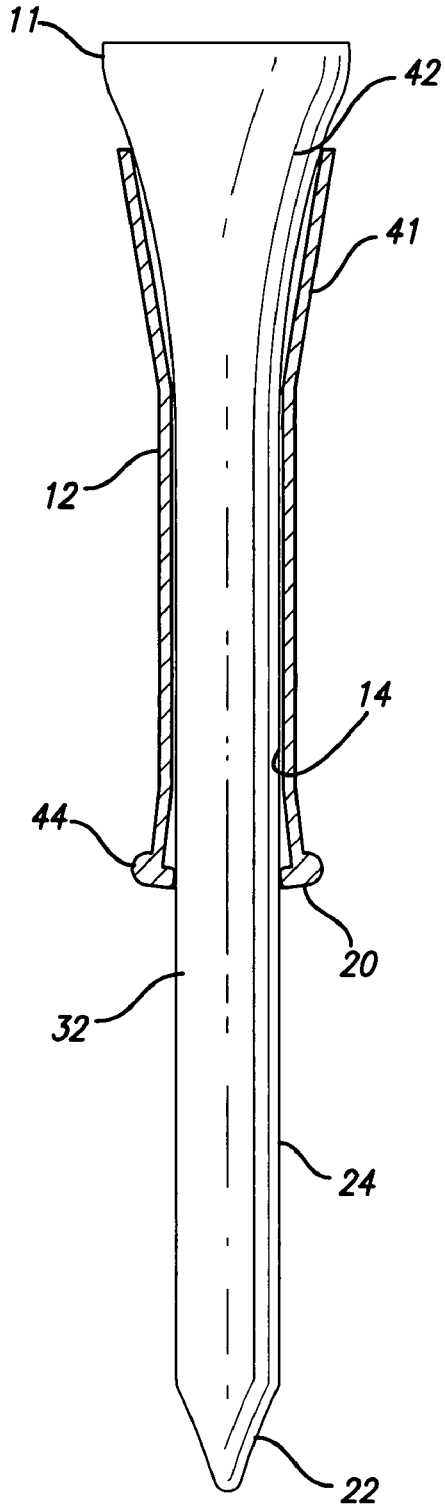
FIG. 6 is a longitudinal cross-sectional view of the device of the present invention shown in combination with a golf tee.

FIG. 6 comprises an alternative embodiment of device 10 wherein enlarged tubular top section 41 diverges conically upwardly from generally tubular sleeve 12 to engage and abut neck portion 42 positioned below top portion 11 of golf tee 24.

Device 10 is adapted for versatile use with golf tees of different lengths and shaft thicknesses. When the thickness of shaft section 32 of golf tee 24 is circumferentially greater than inner diameter 26 of end portion 20, spaced segments 28 are forced to outwardly flare to create an end portion with a wider area to bear against ground surface 25 offering greater stability for golf tee 24 and golf ball 13 perched on its top. The greater the thickness of shaft section 32, the greater the flare, which, in turn, provides greater stability for golf tee 24 and golf ball 13. An annular flange 44, which is formed along leading edges 30 and adapted to radially enlarge end portion 20, allows even a wider area to bear against ground surface 25.

Device 10 may be produced from a wide assortment of materials, though a resilient material with the capability to flex, particularly at end portion 20 of golf tee 24, is preferable.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

The invention claimed is:

1. In combination with a golf tee having a dish-shaped top portion for supporting a golf ball, a neck portion, a shaft section with a certain diameter and a pointed end, a device adapted to assist in inserting the golf tee into the ground to ensure the stability and a pre-determined height for the golf ball, comprising:

(a) a generally tubular sleeve having a neck portion, a shaft portion, a flanged slotted-end portion divided into a first flanged side and a second flanged side, and a hollow cylindrical cavity formed within the longitudinal center of said tubular sleeve to receive said golf tee shaft therethrough, said first flanged side and said second flanged side forming an opening with a diameter smaller than the diameter of said shaft section of golf tee and being adapted to flare outwardly with respect to the shaft portion when engaged by the tee shaft which has been inserted into the device and be disposed to bear against said ground surface; and (b) an enlarged tubular top section diverging upwardly from said generally tubular sleeve to engage and abut said neck portion.

2. The combination defined in claim 1 wherein said top portion of said golf tee has a diameter greater than the diameter of said top section of said device.

3. The combination defined in claim 1 wherein said device is comprised of a flexible resilient material.

4. The combination defined in claim 1 wherein said device is adapted to accommodate assorted sized golf tees with neck portions and shaft sections that vary in diameter.

5. The combination defined in claim 1 wherein said enlarged tubular top section diverges conically upwardly from said generally tubular sleeve to engage and abut said golf ball support.

* * * * *